US010779589B2

(12) United States Patent
James et al.

(10) Patent No.: US 10,779,589 B2
(45) Date of Patent: Sep. 22, 2020

(54) POSTSURGICAL CONVALESCENCE SHIRT

(71) Applicant: Recovery Tee LLC, Oak Ridge, TN (US)

(72) Inventors: Kristi Roberson James, Oak Ridge, TN (US); Kandi Stewart, Euless, TX (US)

(73) Assignee: Recovery Tee LLC, Oak Ridge, TN (US)

( * ) Notice: Subject to any disclaimer, the term of this patent is extended or adjusted under 35 U.S.C. 154(b) by 0 days.

(21) Appl. No.: 16/265,282

(22) Filed: Feb. 1, 2019

(65) Prior Publication Data

US 2019/0159533 A1 May 30, 2019

Related U.S. Application Data

(63) Continuation-in-part of application No. 15/154,462, filed on May 13, 2016, now abandoned.

(60) Provisional application No. 62/162,086, filed on May 15, 2015.

(51) Int. Cl.

| | |
|---|---|
| ***A41D 13/12*** | (2006.01) |
| ***A41C 3/14*** | (2006.01) |
| ***A41D 27/20*** | (2006.01) |

(52) U.S. Cl.

CPC ..... *A41D 13/1245* (2013.01); *A41D 13/129* (2013.01); *A41C 3/148* (2013.01); *A41D 27/20* (2013.01)

(58) Field of Classification Search

CPC .. A41D 1/22; A41D 13/1245; A41D 13/1281; A41D 27/20

USPC ... 2/104, 114, 247, 249, 250, 251, 252, 253, 2/267; 450/2, 7, 11, 14, 31, 32, 86, 88

See application file for complete search history.

(56) References Cited

U.S. PATENT DOCUMENTS

| | | | | |
|---|---|---|---|---|
| 2,888,931 | A * | 6/1959 | Schaumer | A41C 3/06 450/58 |
| 6,048,252 | A * | 4/2000 | Sebring | A41C 3/148 450/1 |
| D657,939 | S | 4/2012 | Mathews | |
| D764,145 | S | 8/2016 | Mathews | |
| 2004/0226073 | A1* | 11/2004 | McCullar | A41D 13/1245 2/114 |
| 2005/0197607 | A1* | 9/2005 | Brown | A61F 5/026 602/19 |
| 2007/0161327 | A1 | 7/2007 | Mineconzo | |
| 2008/0282441 | A1* | 11/2008 | Green | A41D 13/1245 2/69 |
| 2011/0041231 | A1 | 2/2011 | Behrens et al. | |
| 2014/0031775 | A1 | 1/2014 | Criss | |
| 2015/0101102 | A1* | 4/2015 | Theodossiou | A41D 13/1254 2/114 |
| 2016/0249688 | A1* | 9/2016 | Ibey | A41C 3/12 450/88 |

* cited by examiner

*Primary Examiner* — Sally Haden
(74) *Attorney, Agent, or Firm* — Pitts & Lake, P.C.

(57) ABSTRACT

Example embodiments of the present general inventive concept provide a postsurgical convalescence shirt including a placket to open and close the convalescence shirt, and one or more receiving compartments provided inside the convalescence shirt proximate a lower portion thereof, and configured to receive a drain reservoir connected to drainage tubing to drain fluid from a surgical area of a patient's body.

18 Claims, 5 Drawing Sheets

POSTSURGICAL CONVALESCENCE SHIRT

CROSS-REFERENCE TO RELATED APPLICATIONS

This Application is a continuation-in-part of U.S. patent application Ser. No. 15/154,462, filed on May 13, 2016, which claims the benefit of and priority to U.S. Provisional Patent Application Ser. No. 62/162,086, filed on May 15, 2015, the contents of each of which are herein incorporated in their entireties by reference.

FIELD OF INVENTION

The present general inventive concept relates to a convalescence garment, and, more particularly, to a postsurgical convalescence shirt to aid in recovery after surgical procedures requiring drain management.

BACKGROUND

Typically, following some types of medical procedures or surgeries, such as a mastectomy, a patient may need to have one or more drainage devices to drain fluids from the part of the body involved in the procedure. In some cases, the drainage devices may be required even after the patient is discharged from the medical facility, and thus the patient may have more responsibility for the general maintenance of the drainage devices, or at least situating the devices in a comfortable way during convalescence. Although these drains are uncomfortable and inconvenient for the patient, the drains nevertheless encourage healing and recovery by preventing bodily fluids, such as blood and lymphatic fluid, from building up under the patient's skin. In some instances, the tubing extending from the surgical area to a fluid reservoir is simply taped to bandages affixed to the patient, which presents an uncomfortable and inconvenient situation for the patient. Further, as the drains typically need to be utilized throughout the day, the patient may be further inconvenienced or troubled by the aesthetic appearance of the devices. Thus, it may be desirable for a patient to be able to comfortably and safely secure the drainage devices for general wear throughout the day and/or night, and in a way that lessens the visual impact of such a device to promote self-confidence in the patient.

BRIEF SUMMARY

According to various example embodiments of the present general inventive concept, a postsurgical convalescence shirt is provided having one or more internal pockets to conveniently, securely, and discretely hold bodily fluid drain management devices/accessories.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by a postsurgical convalescence shirt including a placket to open and close the convalescence shirt, and one or more receiving compartments provided inside the convalescence shirt proximate a lower portion thereof, and configured to receive a drain reservoir connected to drainage tubing to drain fluid from a surgical area of a patient's body.

The postsurgical convalescence shirt may further include a plurality of securing members provided adjacent to each side of the placket to open and close the convalescence shirt.

The securing members may be configured as plastic snaps.

The one or more receiving compartments may be configured as pockets provided proximate the bottom of the convalescence shirt, with openings at the top of the pockets.

The pockets may include a single layer of fabric sewn directly to the convalescence shirt.

The pockets may be formed of a different fabric than the convalescence shirt, the different fabric being more elastic than that of the convalescence shirt.

The pockets may be formed before being secured to the convalescence shirt.

The one or more of the pockets may be divided into separate receiving areas.

The pockets may be provided with a securing member at the top to secure the drain reservoir and/or or drainage tubing.

The pockets may be configured to be removable from the convalescence shirt, and the convalescence shirt may be provided with one or more securing members to secure the pockets thereto.

At least one or more portions of the convalescence shirt may be formed of a wicking fabric.

The postsurgical convalescence shirt may further include a contrast fabric provided to the placket for decoration and structural support.

The one or more receiving compartments may be configured to hold a largest standard surgical drainage bulb.

The one or more receiving compartments may be configured to hold a post-surgical closed drain suction bulb.

The one or more receiving compartments may be provided at a front of the postsurgical convalescence shirt.

The postsurgical convalescence shirt may further include two breast prosthesis receiving portions provided inside the convalescence shirt, configured to each selectively receive a breast prosthesis, and respectively provided at opposite sides of the placket in a chest area of the convalescence shirt.

The breast prosthesis receiving portions may be configured as breast form pockets attached to the convalescence shirt, each having an opening configured to receive the breast prosthesis at a side of the breast form pocket opposite the placket.

The postsurgical convalescence shirt may further include a support member coupled to each of the breast form pockets at sides opposite the placket, the support member being configured to extend along a back of the convalescence shirt between the breast form pockets to provide support for the breast form pockets.

The support member may be configured as two elastic straps each having first and second ends coupled to the respective breast form pockets in a crossing pattern such that a first end of a first strap is coupled proximate a top portion of a first one of the breast form pockets, a second end of the first strap is coupled proximate a bottom portion of a second one of the breast form pockets, a first end of a second strap is coupled proximate a bottom portion of the first one of the breast form pockets, and a second end of the second strap is coupled proximate a top portion of the second one of the breast form pockets.

The support member may be configured to be selectively attached and detached via coupling members coupling the support member to the breast form pockets.

The two breast prosthesis receiving portions may be configured as a mastectomy bra that is configured to be selectively attached and detached via coupling members coupling the mastectomy bra to a plurality of portions of the convalescence shirt.

The coupling members may be configured so as to inhibit movement of straps of the mastectomy bra.

The coupling members may be loops configured to open to selectively receive and release the mastectomy bra from the convalescence shirt.

The foregoing and/or other aspects and advantages of the present general inventive concept may be achieved by a postsurgical convalescence shirt including a placket to open and close the convalescence shirt, one or more receiving compartments provided inside the convalescence shirt proximate a lower portion thereof, and configured to receive a drain reservoir connected to drainage tubing to drain fluid from a surgical area of a patient's body, and two breast prosthesis receiving portions provided inside the convalescence shirt, configured to each selectively receive a breast prosthesis, and respectively provided at opposite sides of the placket in a chest area of the convalescence shirt, such that one or more breast prostheses may be supported in place in and by the convalescence shirt.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
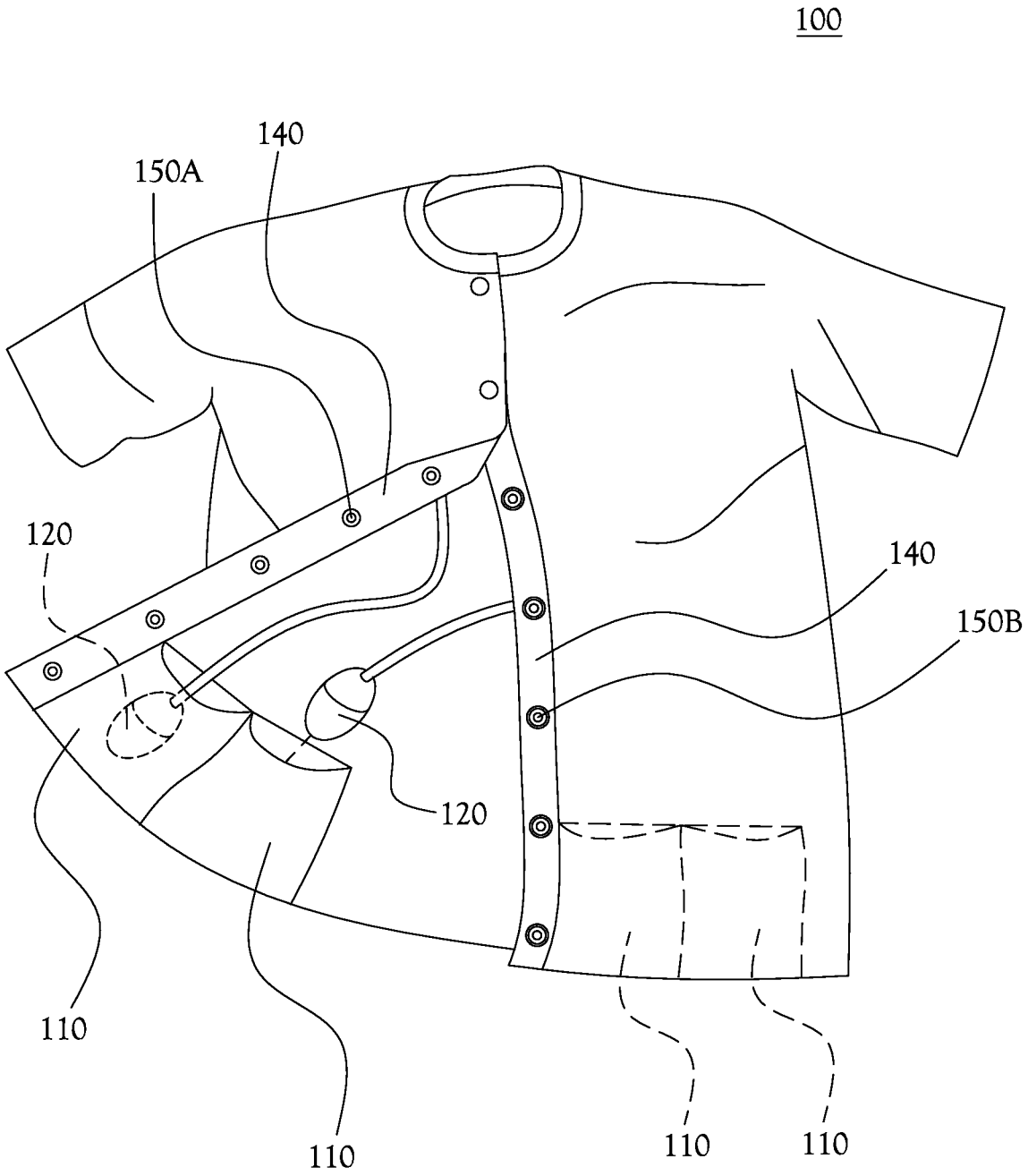
FIG. 1 illustrates a postsurgical convalescence shirt according to an example embodiment of the present general inventive concept.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various examples of the present general inventive concept, a postsurgical convalescence shirt is provided that includes pockets or other such receiving compartments to receive drainage reservoirs to collect fluids, such as blood and lymphatic fluids, that may emanate from wounds, surgical areas of the body, etc. The receiving compartments configured to receive drainage reservoirs may be referred to as pockets at various points in this description for the sake of simplicity, but it is understood that the term pocket is not limiting to the various example embodiments of the receiving compartments.

Various example embodiments of the present general inventive concept are fabricated as comfortable, cost effective, fully-functional drain management post-surgical convalescence shirts that can ease recovery and healing from multiple types of surgery performed on various portions/areas of the body such as, for example, breast, chest, heart, abdominal, etc. The various types of surgery may include, for example, mastectomies, plastic surgery, gastric bypass, etc. Such procedures often include extended convalescent periods during which fluids are drained from affected area of the body, preferably to a reservoir outside the body. The convalescence shirt can aid in a patient's post-operative recovery by allowing easy access and safe containment of drain reservoirs inside the pockets without the use of safety pins, clips, etc., and can be worn during rest, activities, physician follow-up appointments, chemotherapy, radiation, x-rays, diagnostic testing, and so on. The convalescence shirt configuration was initially conceived for recovery after breast surgeries: mastectomy, lumpectomy, reduction, and/or reconstruction. It was tested by breast cancer post-operative mastectomy patients to ensure that its features foster recovery after surgery, with positive results. Further, the applicability and benefit for patients with other types of procedures will be evident to those skilled in the art.

The convalescence shirt according to various example embodiments of the present general inventive concept may be configured to accommodate drainage systems with flexible tubing attached to a soft, plastic bulb with a stopper. The drainage end of the tubing typically enters the patient's body through a small opening near an incision. The bulb is compressed to create a vacuum, creating a constant suction to draw out fluids that collect under the patient's incision. The tube leads outside the patient's body, and is attached to the bulb. The bulb and a portion of the tubing may be contained in the internal pockets during recovery. Drains may typically be removed when the drainage stops, or is less than 25 ml/per day. Conventional post-surgical drain systems used for mastectomies are 100 ml drain bulbs, with approximate dimensions of 5" H×2.5" W. Other sizes may be used based on the different surgical procedures. The pockets of the convalescence shirt according to various example embodiments of the present general inventive concept may be sized according to the predetermined device to be held within.

Figure 2:
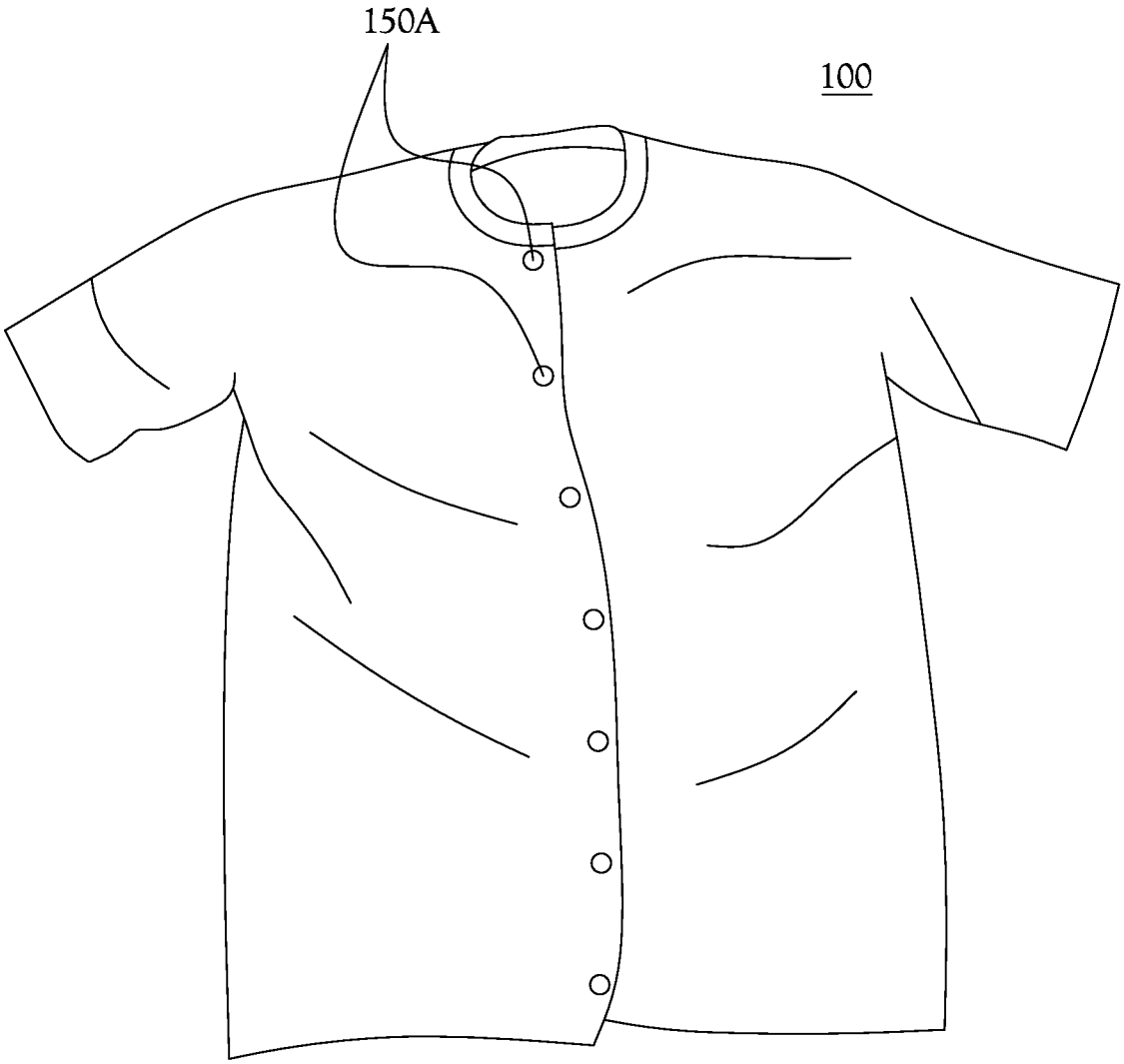
FIG. 2 illustrates the example embodiment of the postsurgical convalescence shirt of FIG. 1 in a closed state.

The postsurgical convalescence shirt according to various example embodiments of the present general inventive concept is configured to promote healing, security, comfort, and modesty to, and to reduce suffering of, the postsurgical patient. FIG. 1 illustrates an example of the postsurgical convalescence shirt according to an example embodiment of the present general inventive concept. The postsurgical convalescence shirt 100 of FIG. 1 is shown partially opened so as to more clearly illustrate various features of the shirt. FIG. 2 illustrates the example embodiment of the postsurgical convalescence shirt of FIG. 1 in a fully closed state.

The example embodiment postsurgical convalescence shirt 100 illustrated in FIG. 1 includes internal pockets 110 configured to receive drainage reservoirs 120 to aid in surgical drain management. The internal pockets 110 are configured to facilitate wound care during the recovery period, which can typically range from one to numerous (six or more) weeks. In the example embodiment illustrated in FIG. 1, four internal pockets 110 are provided, with two pockets being provided on each side of a placket 140 of the postsurgical convalescence shirt 100. It is understood that the present general inventive concept is not limited to this number or configuration of internal pockets 110. In this example embodiment, the two internal pockets 110 on each side of the placket 140 are provided proximate the bottom of the shirt 100 and adjacent to the placket 140 to aid in the draining and minimize the intrusive nature and/or visual impact of medical devices carried in the internal pockets 110. According to various example embodiments, the internal pockets 110 may be sized according to a predetermined medical device which may have a standard size. For example, the internal pockets 110 of an example embodiment of the present general inventive concept may be configured to readily hold a certain type and/or size of fluid reservoir.

Typically, following a mastectomy or other surgery, patients may be discharged with one or more drains coming from the surgical incision site. Although these drains are uncomfortable and inconvenient for the patient, the drains nevertheless encourage healing and recovery by preventing blood and lymphatic fluid buildup under the patient's skin. In some instances, the tubing extending from the surgical area to a fluid reservoir is simply taped to bandages affixed to the patient, which presents an uncomfortable and inconvenient situation for the patient. The drain tubing extending from the incision site may need to remain securely affixed and stable, as the accidental or premature removal of the drain tubing could lead to post-surgical complications.

According to various example embodiments of the present general inventive concept, the internal pocket 110 dimensions may be carefully selected to adequately accommodate multiple drain reservoirs 120 after surgery. Example embodiments of the convalescence shirt 100 may accommodate a maximum amount of drains and fluid that most patients may have during the post-operative period, and allow the patient to securely maintain the drains 120 during recovery. The convalescence shirt 100 of FIGS. 1-2 offers security (no dangling drains), comfort, and modesty for the patient during the healing period. The internal pockets 110 may reduce and/or eliminate the need for safety pins and/or clips.

Although the example embodiment of the present general inventive concept illustrated in FIGS. 1-2 shows two similarly sized internal pockets 110 provided at an inner surface of the shirt 100 on either side of the placket 140 of the shirt 100, it is understood that different quantities, sizes, and placement of the pockets may be provided in other various example embodiments of the present general inventive concept. In various example embodiments, the pockets or receiving compartments may be a single layer of fabric integrated with the shirt to form the pockets, as illustrated in FIGS. 1-2. In various example embodiments, the fabric forming the one or more pockets 110 may not be the same fabric as the shirt. For example, the fabric forming the pockets 110 may be a jersey knit that is more elastic in nature to maintain its shape and contain the drainage reservoirs more effectively. In other various example embodiments, the pockets or receiving compartments 110 may be self-contained or separately formed pockets secured to the shirt by any of various types of securing methods or materials, such as being sewn to the shirt, or may be removable by unbuttoning or the like. Various example embodiments of the present general inventive concept may provide one or more fixed attachment members such as, for example, buttons, snaps, hooks, etc., to interact with corresponding attachment portions of removable internal pockets to aid in customizing pocket sizes and/or desired materials, for cleaning, and so on. In various example embodiments, such fixed attachment members may be provided so as to attach at a plurality of portions of the pocket, such as one or more attachment members at both the top and bottom of the removable pocket, for a more secure attachment. In other various example embodiments, such fixed attachment members may be provided only to attach to top portions of the pockets.

According to various example embodiments, the pockets may be configured to hold various specific drainage reservoirs, such as, for example, for a Jackson-Pratt (JP) drain, or may be of a size, such as 8"×5", for example, that may accommodate a plurality of drainage reservoirs. The Jackson-Pratt (JP) drain has a special tube, placed internally, that extends from the incision to prevent bodily fluid from collecting near the surgical site of the patient's body. The drain pulls this fluid (by suction) into a bulb. The bulb can then be emptied and the fluid inside measured. At first, typically, this fluid may be bloody. Then, as the wound begins to heal, the fluid changes to light pink, light yellow, or clear. The JP drain will typically stay in place until less than 30 cc (about 2 tablespoons) of fluid can be collected in a 24-hour period. During this recovery period, which may last for numerous weeks, the postsurgical convalescence garment can contain the bulb or bulbs safely and securely inside the internal shirt pockets.

In some example embodiments, one or more of the pockets may be provided with a securing member such as a button to help secure the drain reservoir in the pocket, and/or to assist in securing tubing connected to the drain reservoir. In some example embodiments, one or more of the pockets may be divided in to two or more receiving sections. In various example embodiments in which the pockets are formed of an elastic material, the pockets may be sized slightly smaller than a predetermined device, such as the aforementioned JP drain, so that the pocket stretches to receive the device and therefore holds the device snugly in place. In other various example embodiments, the pockets may be sized larger than a predetermined device, to ease the process of placing the device in, and removing the device from, the pockets. Such a configuration may be desired in a situation in which a patient has limited mobility, can only effectively use one hand, and so on.

According to various example embodiments of the present general inventive concept, a plurality of corresponding securing members may be provided along either side adjacent to the placket 140 to close the garment. In the example embodiment illustrated in FIGS. 1-2, the securing members are plastic snap buttons 150A,150B to aid in the ease of opening and closing the shirt, and which may be used during medical procedures such as X-rays, chemo-therapy, etc., without disrupting the procedure. In the example embodiment illustrated in FIGS. 1-2, male snap buttons 150A are received by female snap buttons 150B to securely close the shirt 100. After surgery, patients may have limited mobility for an extended period. As such, otherwise normal activities of daily living become challenging during recovery. Dressing oneself should not be one of the biggest challenges for a patient to be concerned with during this period. For that and other reasons, easy-snap plastic buttons may be selected for ease of dressing in various example embodiments. Snaps are easier to fasten than buttons and are typically more durable than Velcro. The easy-snap buttons allow the shirt to maintain its shape wash after wash. Various example embodiments may be provided with any number of such buttons, such as 10 buttons, according to functional and/or aesthetic desire. However, it is noted that the present general inventive concept is not limited to such plastic buttons configured to snap together. In various example embodiments, the plastic buttons may be chosen rather than metal buttons to allow patients to wear the garment during any diagnostic x-rays, radiation, chemotherapy, and/or other medical procedures. In various embodiments, the buttons may be manufactured from any of a number of plastic or polymer materials, or from hardened organic resins, organic solids, synthetic organic materials, ceramic materials, and similar materials. Polymers used in the fabrication of the buttons, in various example embodiments, include, but are not limited to, polyethylene, high-density polyethylene, polyethylene terephthalate, polyvinyl materials, polyvinylidene materials, high impact polystyrene, polyamides, acrylonitrile butadiene styrene, polycarbonate materials, polyurethanes, polypropylene, and blends and mixtures of the foregoing.

Various example embodiments of the present general inventive concept may be formed with one or more moisture-absorbing fabrics to improve the comfort of the patient. Such fabrics may be selected to ensure the material will foster skin integrity during aftercare of the surgical drains. The fabrics may be elastic in composition to enhance the comfort of the patient. In various example embodiments, a breathable, moisture-absorbing, wicking fabric may be chosen to keep any excessive moisture in check. In addition, various example embodiments may be formed with a fabric that is lightweight, high-quality, with an airy super soft feel, but durable enough to last during the recovery and treatment period and beyond. Such a lightweight soft fabric does not languish or drape on the body, resulting in a more flattering and fashionable garment. Various example embodiments of the convalescence shirt may be formed with cotton woven contrast fabric, such as at the placket 140, for decorative and functionality adding to the detail and embellished at the snap interfacing. The postsurgical convalescence shirt provides a comfortable and functional apparel option as the patient heals.

Various example embodiments of the postsurgical convalescence shirt may be provided in a variety of sizes, such as, for example, small, medium, large, and extra large, and in various colors such as black, navy, pink, and so on. In various example embodiments, the convalescence shirt may be formed of 100% cotton (such as 4.3 ounce, 100% ring spun combed cotton), 100% polyester, or a combination of these or other materials. In various example embodiments, the convalescent shirt may include a contrast fabric for decorative and/or functional fabric adding to the detail, and embellished at the placket. For example, the contrast fabric may be a 2"×25" cotton woven fabric in various example embodiments, and may be provided with various indicia denoting businesses, hospitals, charitable organizations, and so on. The contrast fabric may provide double reinforcement for the placket. In various example embodiments, the placket interfacing may be 1⅞"×25".

According to various example embodiments of the present general inventive concept, a postsurgical convalescence shirt is provided including a placket to open and close the convalescence shirt, and one or more receiving compartments provided inside the convalescence shirt and configured to receive a drain reservoir connected to drainage tubing to drain fluid from a surgical area of a patient's body. The postsurgical convalescence shirt may further include a plurality of securing members provided adjacent to each side of the placket to open and close the convalescence shirt. The securing members may be configured as plastic snaps. The one or more receiving compartments may be configured as pockets provided proximate the bottom of the convalescence shirt, with openings at the top of the pockets. The pockets may include a single layer of fabric sewn directly to the convalescence shirt. The pockets may be formed of a different fabric than the convalescence shirt, the different fabric being more elastic than that of the convalescence shirt. The pockets may be formed before being secured to the convalescence shirt. One or more of the pockets may be divided into separate receiving areas. The pockets may be provided with a securing member at the top to secure the drain reservoir and/or or drainage tubing. At least one or more portions of the convalescence shirt may be formed of a wicking fabric. At least one or more portions of the convalescence shirt may be formed of an elastic fabric. The postsurgical convalescence shirt may further include a contrast fabric provided to the placket for decoration and structural support. The one or more receiving compartments may be configured to hold a largest standard surgical drainage bulb. The one or more receiving compartments may be configured to hold a post-surgical closed drain suction bulb, such as a Jackson-Pratt drain. The one or more receiving compartments may be provided at a front of the postsurgical convalescence shirt.

As previously discussed, one of the surgical procedures which typically requires the patient to be provided with a drainage device is a mastectomy. The postsurgical convalescent shirt according to the present general inventive concept provides a comfortable, discreet, and easy way to position and maintain a proper arrangement for the drainage apparatus. However, a patient having undergone a mastectomy may be prone to suffering a loss of self-esteem due to the change in appearance and feeling after the procedure. Some patients choose not to undergo breast reconstruction for various reasons, while others opt to move forward with reconstruction after a mastectomy. According to each personal situation, some women have unilateral mastectomies, and some women have bilateral mastectomies. For women waiting to undergo reconstruction or those who opt not to undergo this surgery, the Recovery Tee will accommodate the prosthetic breast forms. A breast prosthesis can allow patients to have the appearance of breasts, even during the period before reconstruction.

Various example embodiments of the present general inventive concept may provide both the post-surgical drain management pockets discussed in regard to FIGS. 1-2, and also chest pockets which are each designed to hold a breast prosthesis. There are various types of post-mastectomy and lumpectomy prostheses, also called breast forms. Throughout these descriptions, the terms "breast prosthesis" and "breast form" may be used interchangeably. There are a wide variety of types, shapes, sizes, and colors of breast forms. The type of prosthesis required is determined often by the amount of breast tissue removed. Breast forms are custom-designed for most women. They can be made from several different types of materials, such as silicone gel, foam, or fiberfill, to create something that has a similar weight and feel to natural breast. Some breast forms adhere directly to the chest area, while others fit into special bra pockets that help hold the prosthesis in place. Thus, conventionally, available choices have included wearing a breast prosthesis against the skin, inside the pocket of a mastectomy bra, or attached to the chest wall.

By receiving the prosthetics in the breast form pockets and securely holding these breast forms in place, an example embodiment of the convalescence shirt may function similarly to a mastectomy bra by having a breast form pocket located in the chest region, one provided to each side of the placket. In such a configuration, one breast form can be worn in either pocket, or two breast forms may be worn by providing one in each pocket. The breast form pockets at the chest inside the garment are configured to hold the breast forms in place. In other various example embodiments of the present general inventive concept discussed herein, the convalescence shirt is configured with a readily detachable mastectomy bra with pockets for the forms.

Typically, after surgery the patient's physician will recommend the appropriate time to begin wearing a breast prosthesis. Various example embodiments of the convalescence shirt according to the present general inventive concept were conceptualized with this in mind. During the immediate post-surgical recovery period, patients may not be able to comfortably wear a prosthetic device in any of the conventional arrangements. In such a recovery period, patients are healing and managing drains to allow for proper healing. As previously discussed, the internal pockets at the waist are designed for drain management. With the addition of breast form receiving portions, the garment can, later in the recovery period, also accommodate breast prostheses in the pockets located at the chest in various example embodiments, or in the mastectomy bra selectively attached to various example embodiments. As discussed herein, some example embodiments are provided with a selectively attachable mastectomy bra, portions of which interact with special interlocking loops sewn into the garment, or other various coupling members, to securely hold the mastectomy bra in place. Whether using the built-in breast prosthesis pockets or worn in combination with the selectively attachable mastectomy bra, example embodiments of the present general inventive concept will accommodate both lightweight poly-fill prostheses, foam prostheses, silicone prostheses, or other such prostheses which may aid in the general well-being of the patient during the healing process.

Figure 3A:
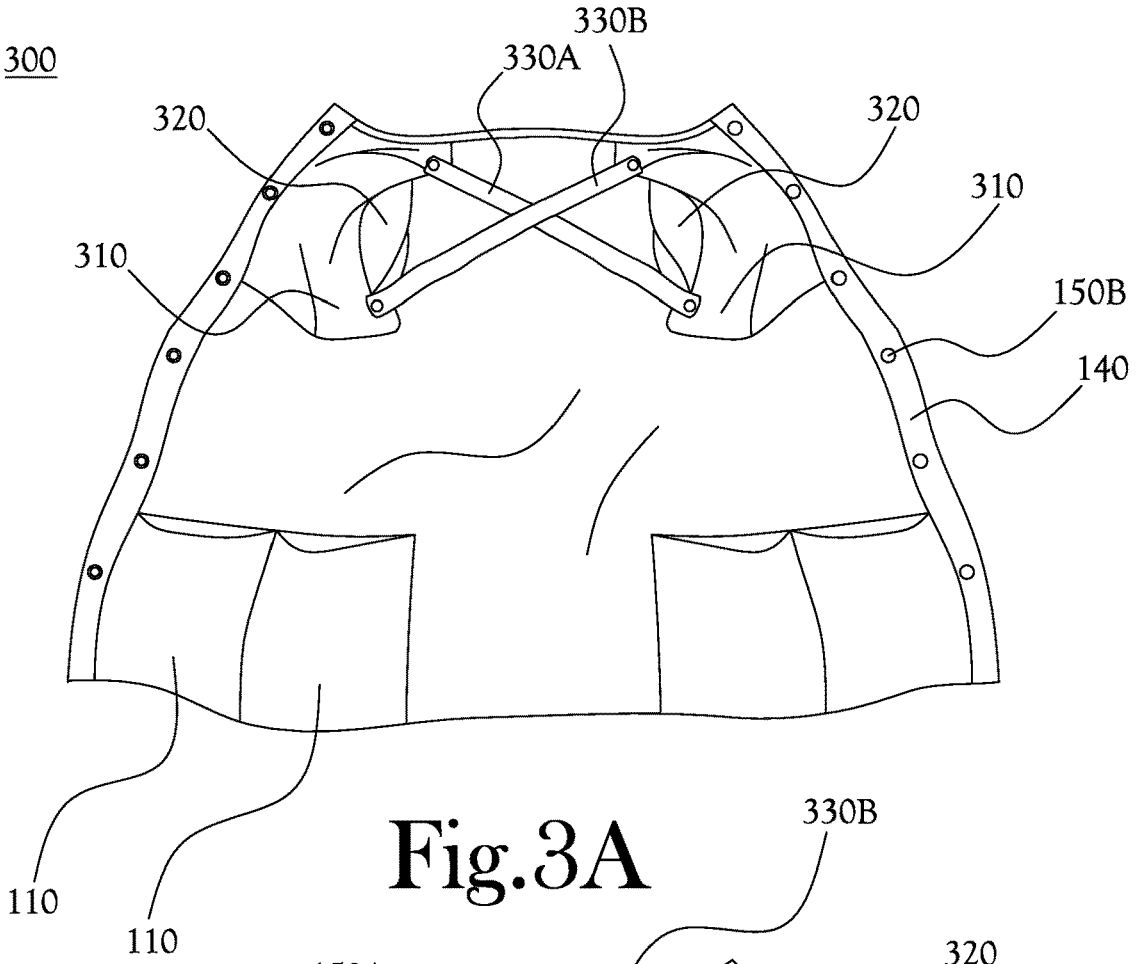
FIGS. 3A-3D illustrate a postsurgical convalescence shirt including breast prosthesis receiving portions according to an example embodiment of the present general inventive concept.
Figure 3B:
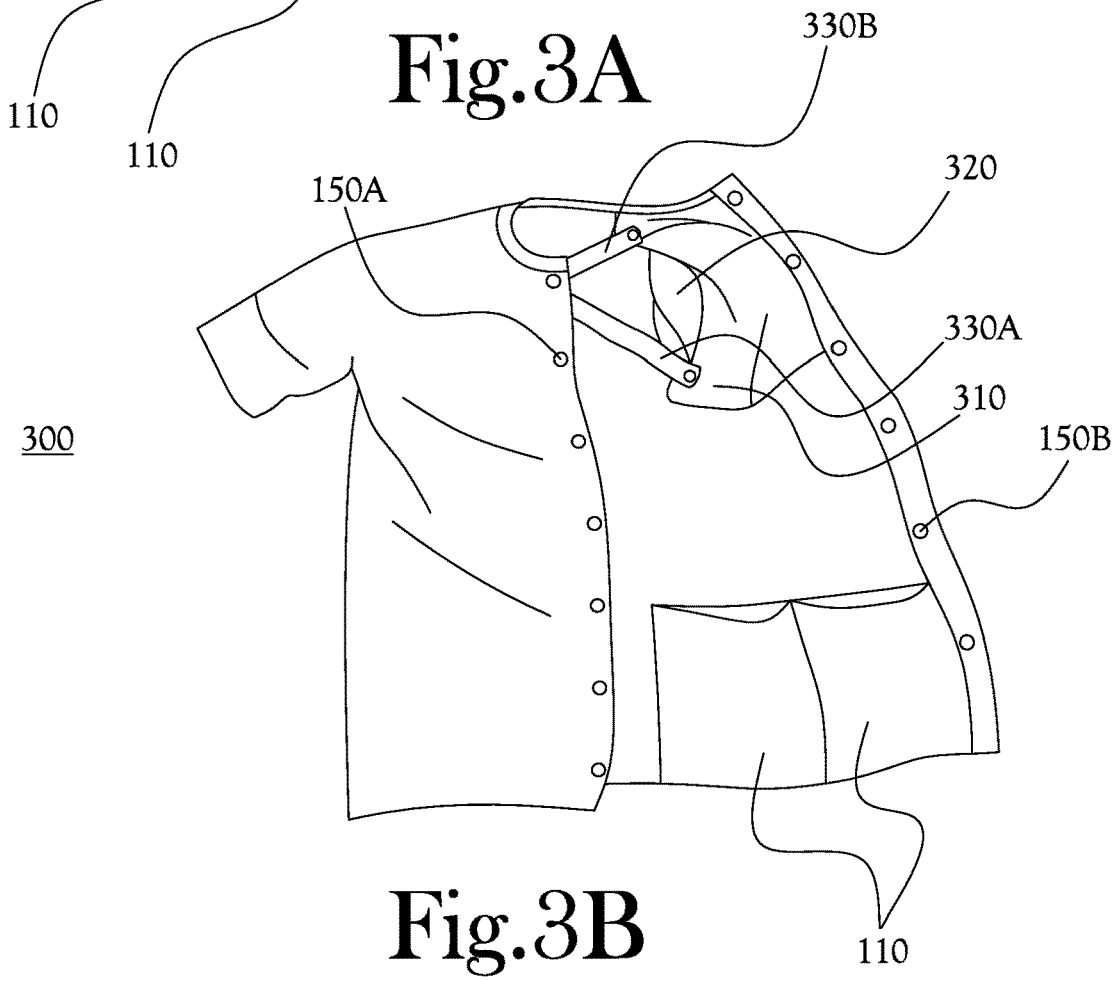
Figure 3C:
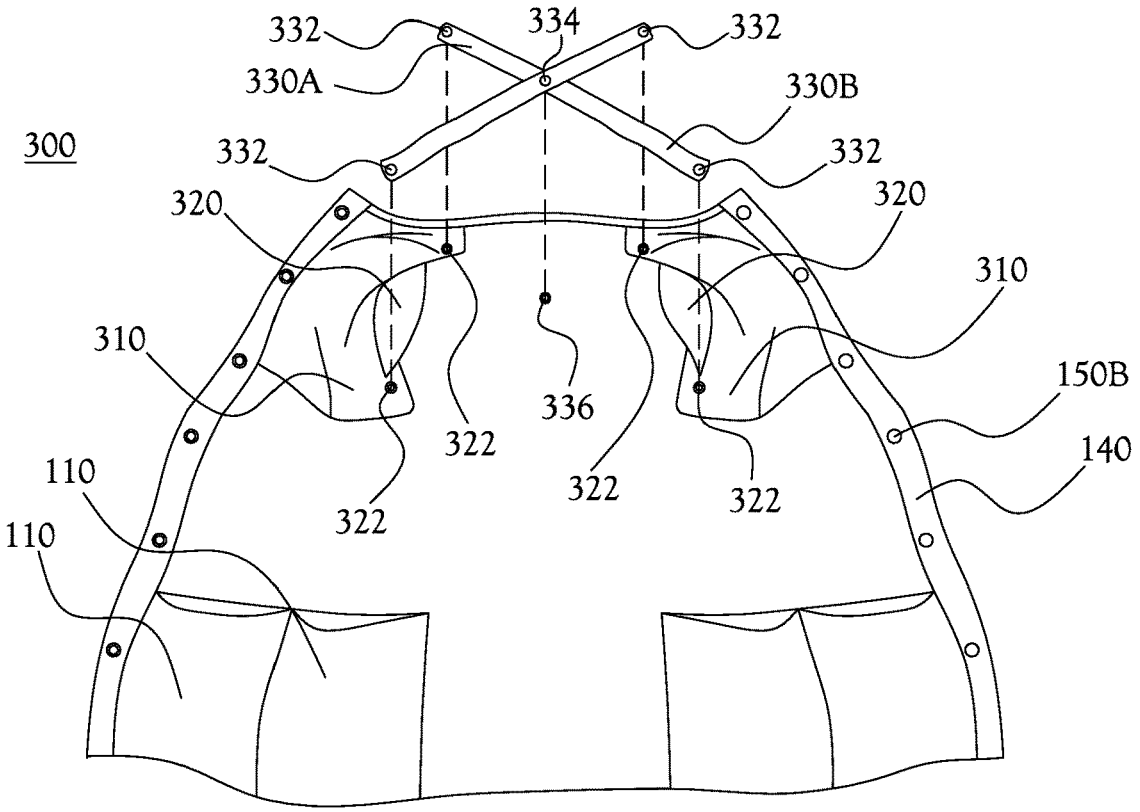
Figure 3D:
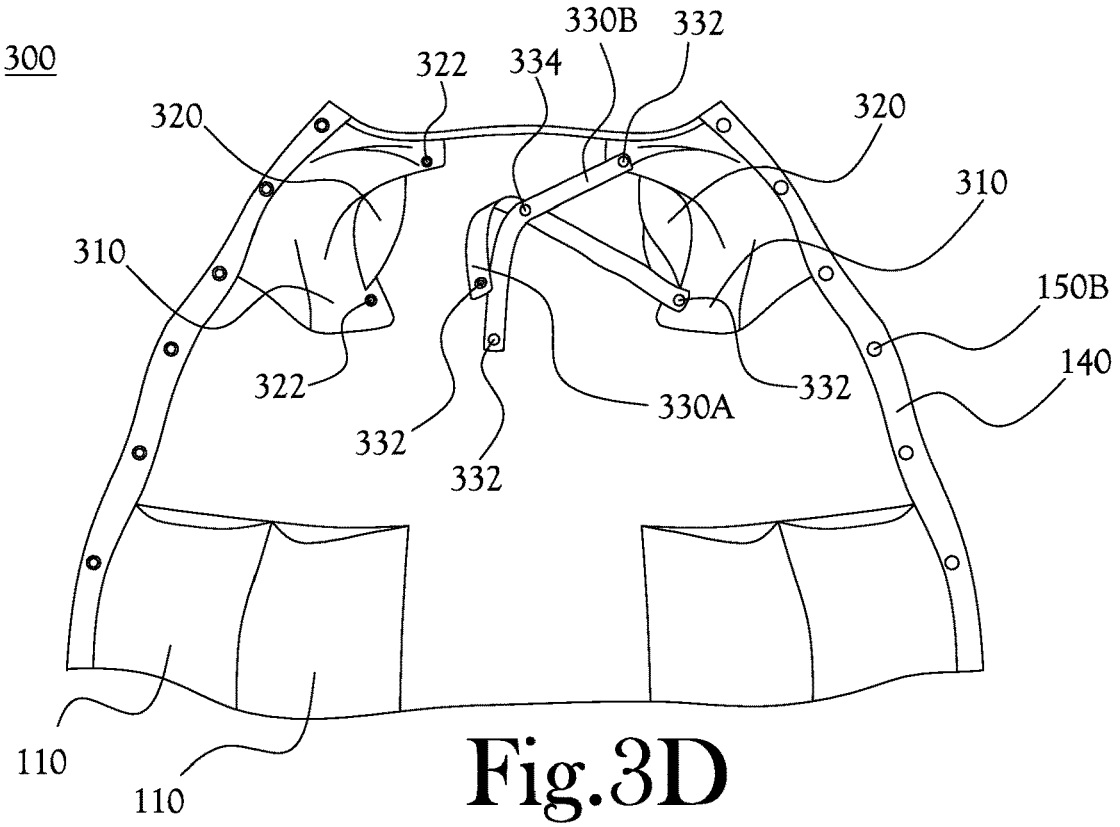

FIGS. 3A-3D illustrate a postsurgical convalescence shirt including breast prosthesis receiving portions according to an example embodiment of the present general inventive concept. FIG. 3A illustrates the example embodiment of the convalescence shirt 300 in a fully open state to more clearly show the features provided therein, and FIG. 3B illustrates the convalescence shirt 300 with one side folded over to a closed state, to show that the outer appearance of the convalescence shirt 300 may look similar to the convalescence shirt 100 illustrated in FIGS. 1-2. FIGS. 3C-3D illustrate the selectively attachable and selectively detachable nature of support members for breast prosthesis receiving portions discussed herein. In the example embodiment illustrated in FIGS. 3A-3D, the convalescence shirt 300 is provided with the lower pockets 110 that were provided in the convalescence shirt 100, but is also provided with breast prosthesis receiving portions configured as breast form pockets 310 inside, and at a chest area of, the convalescence shirt 300. The breast form pockets 310 may be configured to accept and contain a number of different breast prosthesis sizes and/or shapes, or may be configured to be fitted to a predetermined breast form. Similar to the previously discussed lower pockets 110, the breast form pockets 310 may be a single layer of fabric integrated with the shirt 300 to form the pockets, or may be fully formed pockets formed of the same or a different material than the shirt 300. For example, the fabric forming the breast form pockets 310 may be a jersey knit that is more elastic to provide a snug fit to keep the breast forms in place and inhibit movement within the pockets 310. In various example embodiments, the breast form pockets 310 may be selectively removable from the convalescence shirt 300 so that they can be added or removed as needed. The breast form pockets 310 are provided with an opening 320 through which the breast forms may be inserted, removed, or otherwise accessed. In the example embodiment illustrated in FIGS. 3A-3D, the opening 320 is provide at a side of each of the pockets 310 opposite the placket 140, for ease of use before putting the shirt 300 on, and to prevent opening or being seen if a portion of the placket 140 is worn open. In other example embodiments, the opening 320 may be provided at another area of the breast form pockets 310, such as a side adjacent to the placket, to aid in access to the breast form pocket 310 while wearing the shirt 300 for a patient with limited movement. In various example embodiments, a support member may be provided to the convalescence shirt to provide comfort and support for the breast form pockets 310 and breast forms contained therein. Also, in various example embodiments, the support member may be selectively removable so as not to affect the fit and feel of the shirt 300 when breast forms are not worn in the breast form pockets 310. In the example embodiment illustrated in FIGS. 3A-3D, two elastic straps 330A-30B are provided to the shirt 300 and configured in a crossing pattern to provide support similar to that provided by a mastectomy bra. As illustrated, a first end of the strap 330A may be coupled proximate a top of the right pocket at the side opposite the placket 140, and a second end of the strap 330A may be coupled proximate a bottom of the left pocket at the side opposite the placket 140. Similarly, a first end of the strap 330B may be coupled proximate a top of the left pocket at the side opposite the placket 140, and a second end of the strap 330B may be coupled proximate a bottom of the right pocket at the side opposite the placket 140. Such a crossing pattern maintains the position of the breast form pockets 310, as well as providing support for the breast forms. In the example embodiment illustrated in FIG. 3A, the straps 330A-330B are coupled by snaps to the breast form pockets 310 so as to be easily attached and removed as needed. Various example embodiments of the present general inventive concept may provide support members that are selectively removable by coupling to the breast form pockets 310 in any of a number of ways. Also, while the straps 330A-330B are illustrated as separately contained members, a single support member with a different or similar configuration may be provided to prevent loss of one of the straps. FIGS. 3C-3D illustrate the convalescence top 300 with the support members 330A-330B in different states of selective removal from the convalescence top 300. As illustrated in FIG. 3C, the support members 330A-330B have been completely removed from the convalescence top 300 so that the bra-like support is not provided to the breast form pockets 310. This may be desirable in the early convalescence of the patient, when support that is drawn tight to the body is simply too painful or irritating to the patient, but in which the patient may want to still have the breast protheses in place in the shirt to aid in appearance and self-confidence. As illustrated in FIG. 3C, the support members 330A-330B are provided with first support coupling members 332 proximate the distal ends thereof, those first support coupling members 332 being configured to be selectively coupled to respective corresponding second support coupling members 322 that are provided on the breast form pockets 310. As illustrated, the second support coupling members 322 are respectively provided proximate corners of the breast form pockets 310 opposite the placket 140, and thus the patient is able to easily attach and detach the support members 330A-330B to the breast form pockets 310 as desired by the patient. In various example embodiments, the first and second support coupling members 332,322 may be formed as plastic snaps for easy attachment and detachment, and so as not to interfere with x-ray or other types of scanning devices. In the descriptions herein, it is understood that selectively attachable and selectively detachable articles indicate articles that are formed to be readily coupled and decoupled to and from one another according to a user's desire, and without any structural damage, cutting, tearing, etc., to the articles or items incorporating the articles. Thus, the coupling members are provided so that a patient can easily and repeatedly attach and/or remove the support members 330A-330B with a relatively simple motion, e.g., snapping/unsnapping, buttoning/unbuttoning, etc., without additional tools or any damaging of the convalescence top 300, breast form pockets 310, or support members 330A-330B. In various example embodiments, the support members 330A-330B may also be provided with one or more third support coupling members 334, and the convalescence top 300 may be provided with one or more fourth coupling members 336, to selectively attach and selectively detach the support members 330A-330B to the inside of the back of the convalescence top 300 to provide additional support as needed. As illustrated in FIG. 3C, a fourth coupling member 336 is located inside the back of the shirt proximate a point at which the support members 330A-330B cross, and is configured to be selectively coupled to the third coupling member 334 that is provided to the support members 330A-330B proximate the point at which the support members 330A-330B cross. Such a coupling may provide more support and/or help to keep the support members 330A-330B in place when selectively attached to the convalescence top 300. As illustrated in FIG. 3D, such a selective coupling of the support members 330A-330B to the convalescence top 300 in this manner also allows the patient to selectively couple the support members 330A-330B to only one of the breast form pockets 310 if desired. As illustrated, the support members 330A-330B have not been attached to the right breast prosthesis pocket 310, but have been attached to the left breast prosthesis pocket 310, to provide support to the left breast prosthesis pocket 310 only. In various example embodiments of the present general inventive concept, the support members 330A-330B may be optionally formed in a one-sided configuration to provide a fit such as that illustrated in FIG. 3D without having unused portions of the straps being present. In other various example embodiments, the support members 330A-330B may be configured to be selectively separated into right and left portions to selectively provide support for only one of the breast prosthesis pockets 310. Such a configuration may provide for the easy separation of the two halves of the support members 330A-330B using the third and fourth support coupling members 334,336 by, for example, having right and left portions with through holes to accept the male portion of the third and fourth support coupling members 334,336. In various example embodiments, the support members 330A-330B may be separately formed straps, or may be integrally formed, such as being attached at a point where the straps cross one another. With such selectively attachable and detachable support members, a patient can use the same garment to easily transition from no breast prostheses, to one or two breast prostheses without support, to one or two breast prostheses with support.

Thus, various example embodiments of the present general inventive concept provide a convalescence top with two optional breast prosthesis receiving pockets provided inside the convalescence top, configured to each selectively receive a breast prosthesis, and respectively provided at opposite sides of the placket in a chest area of the convalescence shirt, such that one or more breast prostheses may be supported in place in and by the convalescence shirt. The garment may feature a detachable, posterosuperior embodiment with crisscross, securing straps to support one or two breast prosthetic forms. This feature is optional and could be used for prosthetic breast forms after the patient heals and receives medical clearance. Straps do not rub against the newly healed incisions, instead the support is created from the crisscross straps in the back of the garment. Until a patient can tolerate a mastectomy bra or camisole, this is a viable option to allow a patient to use a prosthetic breast from and continue to avoid the sensitive surgical incision. It can be used as a transition garment until patient's pain tolerance is lowered; whereby, a patient can later begin wearing a tight-fitting garment upon the sensitive surgical area. This supports bilateral or unilateral mastectomy patients prior to breast reconstruction, if a patient elects to undergo additional breast reconstruction surgery. One or two breast prosthetic forms can be used, designed to support the appearance of breasts for patients after post-surgical recovery. If patients want the appearance of breasts, but opt to undergo reconstruction or not have it all, a prosthesis, also called a breast form, can help a patient to have the appearance of breasts. A prosthesis is the fastest way to fill the space where breast(s) were after a mastectomy. This provides comfort to patients, especially after losing a breast and making so many major decisions. The garment supports a lightweight prosthetic form (polyfill or foam), as this is most comfortable after surgery. Many patients are unable to undergo immediate reconstruction following a mastectomy, or they may opt to not undergo additional surgery.

Figure 4A:
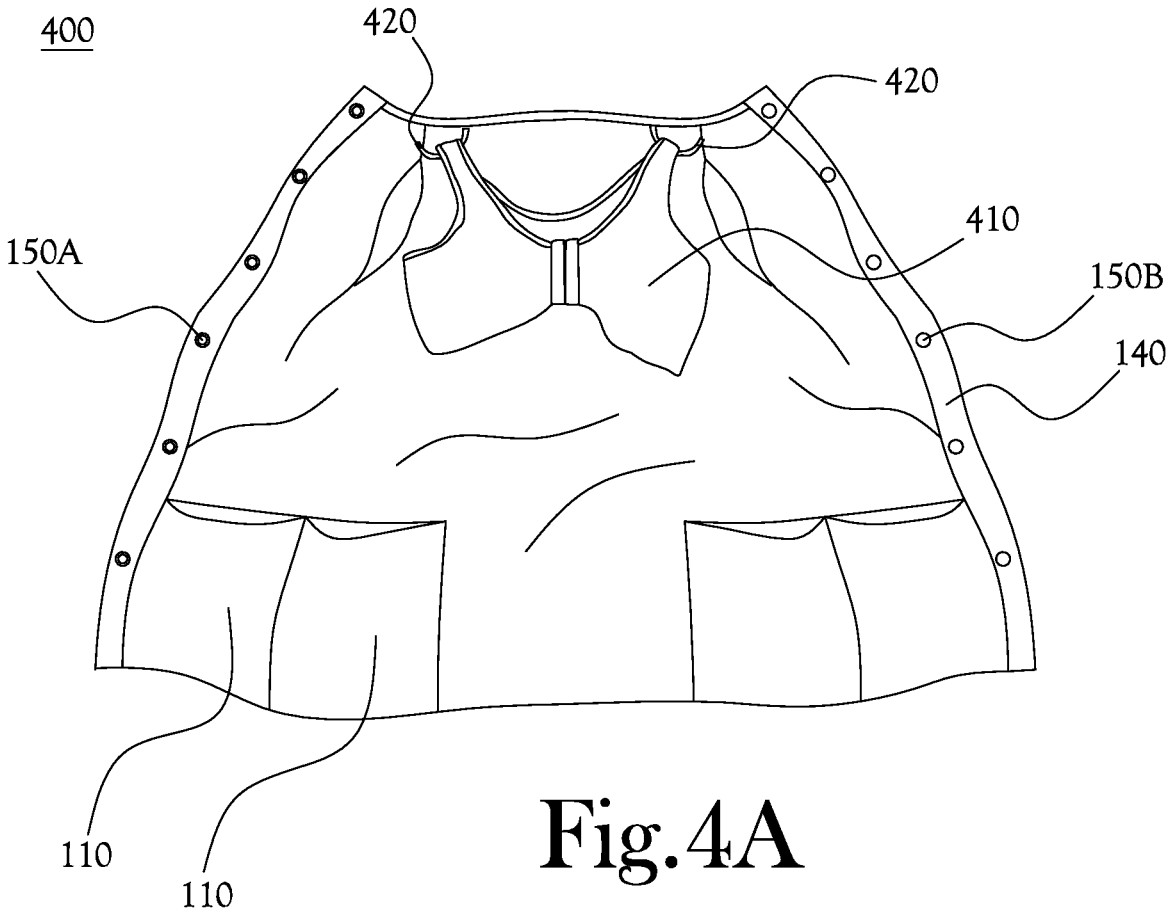
FIGS. 4A-4B illustrate a postsurgical convalescence shirt including breast prosthesis receiving portions according to another example embodiment of the present general inventive concept.
Figure 4B:
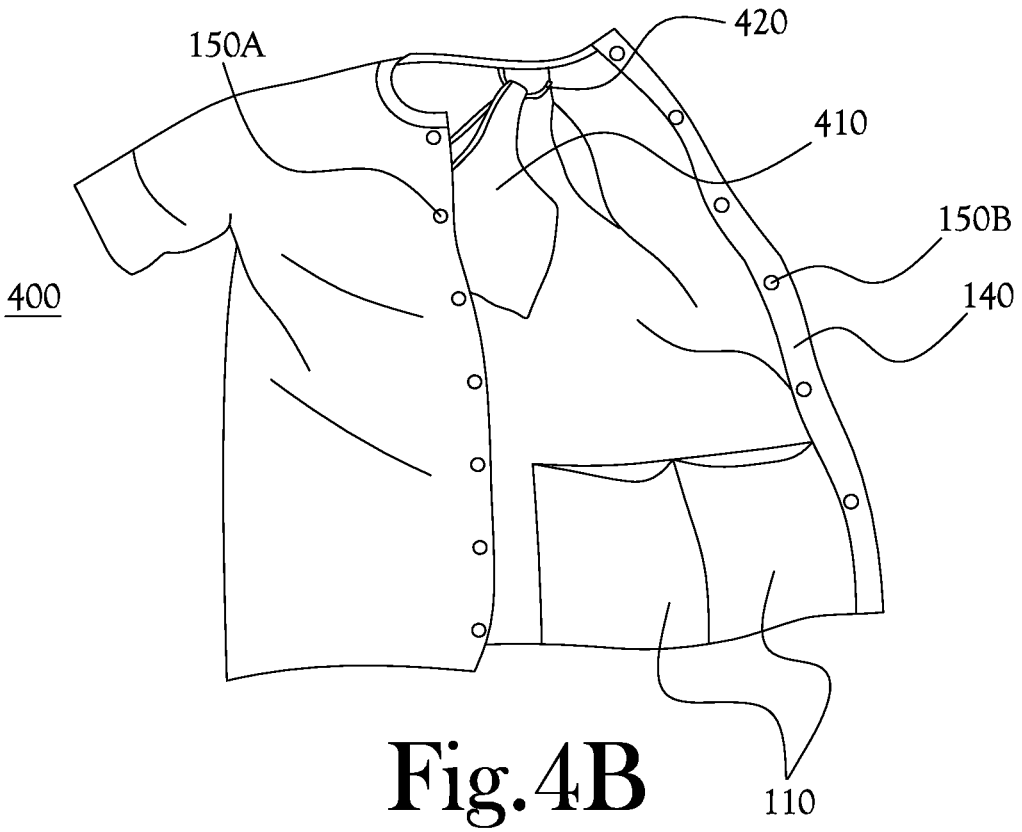

FIGS. 4A-4B illustrate a postsurgical convalescence shirt including breast prosthesis receiving portions according to another example embodiment of the present general inventive concept. FIG. 4A illustrates the example embodiment of the convalescence shirt 400 in a fully open state to more clearly show the features provided therein, and FIG. 4B illustrates the convalescence shirt with one side folded over to a closed state, to show that the outer appearance of the convalescence shirt 400 may look similar to the convalescence shirt 100 illustrated in FIGS. 1-2. In the example embodiment illustrated in FIGS. 4A-4B, the convalescence shirt 400 is provided with the lower pockets 110 that were provided in the convalescence shirt 100, but is also provided with breast prosthesis receiving portions configured as a mastectomy bra 410 that is selectively coupled to the convalescence shirt 400. In the example embodiment illustrated in FIGS. 4A-4B, the mastectomy bra 410, which is known to have integrated pockets to receive and maintain breast forms (and therefore the pockets are not illustrated), is coupled to the convalescence shirt 400 by loops 420 provided inside and proximate the top of the shirt 400 to receive straps of the mastectomy bra 410. By coupling the mastectomy bra 410 to the convalescence shirt 400, several advantages are enjoyed by the patient. Such an attachment allows the patient to put both garments on at the same time, which is valuable to the patient for which any movement is painful. In various example embodiments, the mastectomy bra 410 may be provided with a coupling portion to be coupled to an inner portion of the convalescence shirt 400 to keep the mastectomy bra 410 in an open state while the patient puts the shirt 400 and bra 410 on, which reduces the number of movements the patient must make. The attachment of the mastectomy bra 410 to the convalescence shirt 400 by the loops 420 also aids in organization by keeping the items together. As another example of the benefits of the example embodiment of FIGS. 4A-4B, the loops 420 aid in keeping the straps of the mastectomy bra 410 in place. The loops 420 illustrated in FIGS. 4A-4B may be coupled at at least one end to the convalescence shirt 400 for easy opening to selectively remove the mastectomy bra 410 from the convalescence shirt 400. The coupling may be provided by snaps for easy manipulation of the loops 420 in the attachment or removal of the mastectomy bra 410. The coupling may be provided at each end of the loops 420 to provide easy removal of the loops 420 along with the mastectomy bra 410. Various other example embodiments may provide different types of coupling members to couple the mastectomy bra 410 to the convalescence shirt 400, or different quantities and/or placements of the loops 420, and so on without departing from the scope of the present general inventive concept.

Various example embodiments of the present general inventive concept may provide a postsurgical convalescence shirt including a placket to open and close the convalescence shirt, one or more receiving compartments provided inside the convalescence shirt proximate a lower portion thereof, and configured to receive a drain reservoir connected to drainage tubing to drain fluid from a surgical area of a patient's body, two breast prosthesis receiving portions provided inside the convalescence shirt, configured to each selectively receive a breast prosthesis, and respectively provided at opposite sides of the placket in a chest area of the convalescence shirt, a support member configured to be selectively coupled and selectively decoupled to each of the breast form pockets at sides opposite the placket, the support member being configured to extend along a back of the convalescence shirt between the breast form pockets to selectively provide support for the breast form pockets, one or more first support coupling members provided proximate respective distal ends of the support member, and one or more second support coupling members provided to the respective breast prosthesis receiving portions and configured to correspond to the respective one or more first support coupling members, wherein the support member is configured to be selectively attached and detached via the first and second support coupling members. The postsurgical convalescence shirt may further include a plurality of securing members provided adjacent to each side of the placket to open and close the convalescence shirt. The securing members may be configured as plastic snaps. The one or more receiving compartments may be configured as pockets provided proximate a bottom of the convalescence shirt, each of the pockets having an opening proximate a top of the respective pockets. The pockets may include a single layer of fabric sewn directly to the convalescence shirt. The pockets may be formed of a different fabric than the convalescence shirt, the different fabric being more elastic than the convalescence shirt. The pockets may or may not be integral to the convalescence shirt. One or more of the pockets may be divided into separate receiving areas. The pockets may be provided with a securing member at the respective tops of the pockets to secure the drain reservoir and/or or drainage tubing. At least one or more portions of the convalescence shirt may be formed of a wicking fabric. The postsurgical convalescence shirt may further include a contrast fabric provided to the placket for decoration and structural support. The one or more receiving compartments may be configured to hold a post-surgical closed drain suction bulb. The one or more receiving compartments may be provided at a front of the postsurgical convalescence shirt. The breast prosthesis receiving portions may be configured as breast form pockets attached to the convalescence shirt, each having an opening configured to receive the breast prosthesis at a side of the breast form pocket opposite the placket. The support member may be configured as two elastic straps each having first and second ends coupled to the respective breast form pockets in a crossing pattern such that a first end of a first strap is coupled proximate a top portion of a first one of the breast form pockets, a second end of the first strap is coupled proximate a bottom portion of a second one of the breast form pockets, a first end of a second strap is coupled proximate a bottom portion of the first one of the breast form pockets, and a second end of the second strap is coupled proximate a top portion of the second one of the breast form pockets. The postsurgical convalescence shirt may further include one or more third support coupling members provided proximate a center of the support member, and one or more fourth support coupling members provided to an inner surface at the back of the convalescence shirt, wherein the one or more third support coupling members are configured to be selectively attached and selectively detached from the one or more fourth support coupling members to selectively secure the support member to the back of the convalescence shirt. The support member may or may not only be attached to the convalescence shirt at points of the first, second, third, and fourth support coupling members when the support member is selectively coupled to the convalescence shirt. The support member may or may not only be attached to the convalescence shirt at points of the first and second support coupling members when the support member is selectively coupled to the convalescence shirt. The first and second support coupling members may be configured as snaps. The support member may be configured to be selectively separated into right and left portions to selectively provide support for only one of the breast prosthesis receiving portions.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering and medical judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A postsurgical convalescence shirt comprising:

a placket to open and close the convalescence shirt;

one or more receiving compartments provided inside the convalescence shirt proximate a lower portion thereof, and configured to receive a drain reservoir connected to drainage tubing to drain fluid from a surgical area of a patient's body;

two breast prosthesis receiving portions provided inside the convalescence shirt, configured to each selectively receive a breast prosthesis, and respectively provided at opposite sides of the placket in a chest area of the convalescence shirt;

a support member configured to be selectively coupled and selectively decoupled to each of the breast prosthesis receiving portions at sides of the respective breast prosthesis receiving portions positioned opposite the placket, the support member being configured to extend along a back and inside of the convalescence shirt between the breast prosthesis receiving portions to selectively provide support for the breast prosthesis receiving portions;

one or more first support coupling members provided proximate respective distal ends of the support member; and one or more second support coupling members provided to the respective breast prosthesis receiving portions and configured to correspond to the respective one or more first support coupling members;

wherein the support member is configured to be selectively attached and detached via the first and second support coupling members;

wherein the two breast prosthesis receiving portions are each configured as breast form pockets attached to the convalescence shirt, each breast form pocket having an opening configured to receive the breast prosthesis at a side of the breast form pocket opposite the placket;

wherein the support member is configured as two elastic straps having respective first and second ends coupled to the respective breast form pockets in a crossing pattern such that a first end of a first strap is coupled proximate a top portion of a first one of the breast form pockets, a second end of the first strap is coupled proximate a bottom portion of a second one of the breast form pockets, a first end of a second strap is coupled proximate a bottom portion of the first one of the breast form pockets, and a second end of the second strap is coupled proximate a top portion of the second one of the breast form pockets.

2. The postsurgical convalescence shirt of claim 1, further comprising a plurality of securing members provided adjacent to the placket to open and close the convalescence shirt.

3. The postsurgical convalescence shirt of claim 2, wherein the securing members are configured as plastic snaps.

4. The postsurgical convalescence shirt of claim 1, wherein the one or more receiving compartments are configured as pockets provided proximate a bottom of the convalescence shirt, each of the pockets having an opening proximate a top of the respective pockets.

5. The postsurgical convalescence shirt of claim 4, wherein the pockets comprise a single layer of fabric sewn directly to the convalescence shirt.

6. The postsurgical convalescence shirt of claim 5, wherein the pockets are formed of a different fabric than the convalescence shirt, the different fabric being more elastic than the convalescence shirt.

7. The postsurgical convalescence shirt of claim 4, wherein the pockets are not integral to the convalescence shirt.

8. The postsurgical convalescence shirt of claim 4, wherein one or more of the pockets is divided into separate receiving areas.

9. The postsurgical convalescence shirt of claim 4, wherein the pockets are provided with a securing member at the respective tops of the pockets to secure the drain reservoir and/or or drainage tubing.

10. The postsurgical convalescence shirt of claim 1, wherein at least one or more portions of the convalescence shirt is formed of a wicking fabric.

11. The postsurgical convalescence shirt of claim 1, further comprising a contrast fabric provided to the placket for decoration and structural support.

12. The postsurgical convalescence shirt of claim 1, wherein the one or more receiving compartments are configured to hold a post-surgical closed drain suction bulb.

13. The postsurgical convalescence shirt of claim 1, wherein the one or more receiving compartments are provided at a front of the postsurgical convalescence shirt.

14. The postsurgical convalescence shirt of claim 1, further comprising:

one or more third support coupling members provided proximate a center of the support member; and one or more fourth support coupling members provided to an inner surface at the back of the convalescence shirt;

wherein the one or more third support coupling members are configured to be selectively attached and selectively detached from the one or more fourth support coupling members to selectively secure the support member to the back of the convalescence shirt.

15. The postsurgical convalescence shirt of claim 14, wherein the support member is only attached to the convalescence shirt at points of the first, second, third, and fourth support coupling members when the support member is selectively coupled to the convalescence shirt.

16. The postsurgical convalescence shirt of claim 1, wherein the support member is only attached to the convalescence shirt at points of the first and second support coupling members when the support member is selectively coupled to the convalescence shirt.

17. The postsurgical convalescence shirt of claim 1, wherein the first and second support coupling members are configured as snaps.

18. The postsurgical convalescence shirt of claim 1, wherein the support member is configured to be selectively separated into right and left portions to selectively provide support for only one of the breast prosthesis receiving portions.

* * * * *